US007564410B2

(12) United States Patent
Lee

(10) Patent No.: US 7,564,410 B2
(45) Date of Patent: Jul. 21, 2009

(54) DUAL RADIATING TYPE INNER ANTENNA FOR MOBILE COMMUNICATION TERMINAL

(75) Inventor: Jong In Lee, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 195 days.

(21) Appl. No.: 11/706,852

(22) Filed: Feb. 15, 2007

(65) Prior Publication Data

US 2008/0007476 A1 Jan. 10, 2008

(30) Foreign Application Priority Data

Jul. 10, 2006 (KR) ..... 10-2006-0064632

(51) Int. Cl.
*H01Q 1/38* (2006.01)
*H01Q 1/24* (2006.01)
*H01Q 21/00* (2006.01)

(52) U.S. Cl. ..... 343/702; 343/700 MS; 343/853; 343/850

(58) Field of Classification Search ..... 343/702, 343/700 MS, 853, 850
See application file for complete search history.

(56) References Cited

U.S. PATENT DOCUMENTS 6,940,457 B2 * 9/2005 Lee et al. ..... 343/700 MS
6,956,536 B2 * 10/2005 Lee ..... 343/793
7,091,907 B2 * 8/2006 Brachat ..... 343/700 MS

* cited by examiner

*Primary Examiner*—Michael C Wimer
*Assistant Examiner*—Jennifer F Hu
(74) *Attorney, Agent, or Firm*—The Farrell Law Firm, LLP

(57) ABSTRACT

The dual radiating type inner antenna includes a Printed Circuit Board (PCB), a first radiation plate disposed at an upper part of the PCB, a power supply unit connecting the PCB and the first radiation plate to supply a current to the first radiation plate, a power supply pad, a floating patch, and a second radiation plate. Current supplied to the power supply pad is radiated as first electromagnetic waves through the first radiation plate after passing through the power supply unit; and is radiated as second electromagnetic waves through the second radiation plate after being coupled through the slot of the floating patch to the power supply pad. Therefore, the inner antenna simultaneously radiates electromagnetic waves of different frequency bands, so that a usable frequency bandwidth can be expanded and the gain of the antenna can be increased. Accordingly, the inner antenna can maintain a stable antenna performance by solving a deterioration problem caused by a frequency shift due to an effect of a human body.

5 Claims, 3 Drawing Sheets

DUAL RADIATING TYPE INNER ANTENNA FOR MOBILE COMMUNICATION TERMINAL

PRIORITY

This application claims priority to an application entitled "DUAL RADIATING TYPE INNER ANTENNA FOR MOBILE COMMUNICATION TERMINAL" filed in the Korean Intellectual Property Office on Jul. 10, 2006 and assigned Ser. No. 2006-0064632, the contents of which are incorporated herein by reference.

BACKGROUND OF THE INVENTION

1. Field of the Invention

The present invention relates to an antenna for a mobile communication terminal, and, more particularly, to a dual radiating type inner antenna, which is provided within a case, for a mobile communication terminal.

2. Description of the Related Art

In general, an antenna is provided in a mobile communication terminal to transmit and receive electric waves. A conventional antenna protrudes to a predetermined height from an upper end of a mobile communication terminal case.

However, because a protruding antenna easily comes in contact with other objects, it is somewhat inconvenient to carry the mobile communication terminal. Particularly, the protruding antenna is easily damaged by external impact.

In order to solve such a problem, a mobile communication terminal was introduced in which an antenna is provided within a case. The inner antenna is also called an "intenna".

FIG. 1 is a perspective view schematically illustrating a conventional inner antenna 100 for a mobile communication terminal. FIG. 2 is a cross-sectional view of the inner antenna taken along line II-II of FIG. 1.

Referring to FIGS. 1 and 2, the conventional inner antenna 100 includes a radiation plate 20 connected through a power supply unit 30 to an upper surface of a printed circuit board (PCB) 10 that is provided within a case 40. The PCB 10 has a structure in which a power supply pad 13 is formed in an upper surface and a ground layer 16 is formed in a lower surface of an insulating board body 12. The power supply unit 30 is bonded to the power supply pad 13.

The conventional inner antenna 100 radiates electromagnetic waves 50 of a predetermined frequency band through the radiation plate 20 when a current is supplied to the power supply unit 30 through the power supply pad 13. Because the lower surface of the PCB 10 under the radiation plate 20 is covered with the ground layer 16, the electromagnetic waves 50 are only radiated to an upper part of the radiation plate 20.

Because the conventional inner antenna 100 radiates electromagnetic waves 50 in only one direction through the radiation plate 20, a frequency bandwidth of the radiated electromagnetic waves 50 is limited, so that the inner antenna 100 is unable to function in an expanded frequency bandwidth.

When a mobile communication terminal is used for telephone communication, a user generally uses the terminal by holding the case 40 with one hand and bringing the terminal close to the user's head, whereby a frequency shift due to an effect of the human body may be generated. However, because the frequency bandwidth of the inner antenna 100 is limited, the shifted frequency may deviate from the frequency bandwidth of the inner antenna 100. In this case, the mobile communication terminal may not properly perform due to deterioration of the inner antenna performance.

SUMMARY OF THE INVENTION

The present invention has been made in an effort to solve the above problems, and an object of the present invention is to provide a dual radiating type inner antenna for a mobile communication terminal that can expand a frequency bandwidth of the inner antenna.

In accordance with an aspect of the present invention, the above and other objects are accomplished by a dual radiating type inner antenna for a mobile communication terminal including a PCB; a first radiation plate provided at an upper part of the PCB; and a power supply unit connecting the PCB and the first radiation plate to supply a current to the first radiation plate. The PCB includes a board body and a plurality of metal wiring layers formed in the board body. The board body has an upper surface and a lower surface opposite to the upper surface. The metal wiring layer includes a power supply pad formed in the upper surface of the board body under the first radiation plate and to which the power supply unit is connected; a floating patch formed within the board body and having a slot of a size greater than that of the power supply pad formed corresponding to the location of the power supply pad; a second radiation plate formed in the lower surface of the board body under the first radiation plate; and a ground layer disposed a part from the second radiation plate and formed in the lower surface of the board body. Electric current supplied to the power supply unit through the power supply pad is radiated as electromagnetic waves of a predetermined frequency band through the first radiation plate, and is radiated as electromagnetic waves of a predetermined frequency band through the second radiation plate after the current is coupled through the slot of the floating patch from the power supply pad.

Preferably, the first radiation plate covers the second radiation plate. The floating patch covers the second radiation plate. The second radiation plate covers the slot of the floating patch.

Preferably, the slot of the floating patch has one of a straight shape, a U shape, and a dumbbell shape, i.e. a shape with a narrow straight central section and ends wider than the central section.

Preferably, the power supply unit is connected to a central part of the first radiation plate. The power supply pad is positioned in a central part of the slot.

In accordance with another aspect of the present invention, the above and other objects are accomplished by a dual radiating type inner antenna for a mobile communication terminal including a PCB, a first radiation plate, and a power supply unit. The PCB has an upper surface and a lower surface opposite to the upper surface. The first radiation plate is disposed at the upper surface of the PCB. The power supply unit connects the PCB and the first radiation plate to supply electrical current to the first radiation plate. The PCB includes a power supply pad, a floating patch, a second radiation plate, and a ground layer. The power supply pad is formed in the upper surface of the PCB and the power supply unit is bonded thereto. The floating patch is formed within the PCB and a slot of a size greater than that of the power supply pad is formed therein corresponding to the location of the power supply pad. The second radiation plate is formed in the lower surface of the PCB under the floating patch and has a size greater than that of the slot. The ground layer covers the lower surface of the PCB except the second radiation plate.

BRIEF DESCRIPTION OF THE DRAWINGS

The above and other objects, features and advantages of the present invention will be more apparent from the following detailed description in conjunction with the accompanying drawings, in which.

DETAILED DESCRIPTION OF PREFERRED EMBODIMENTS

Figure 1:
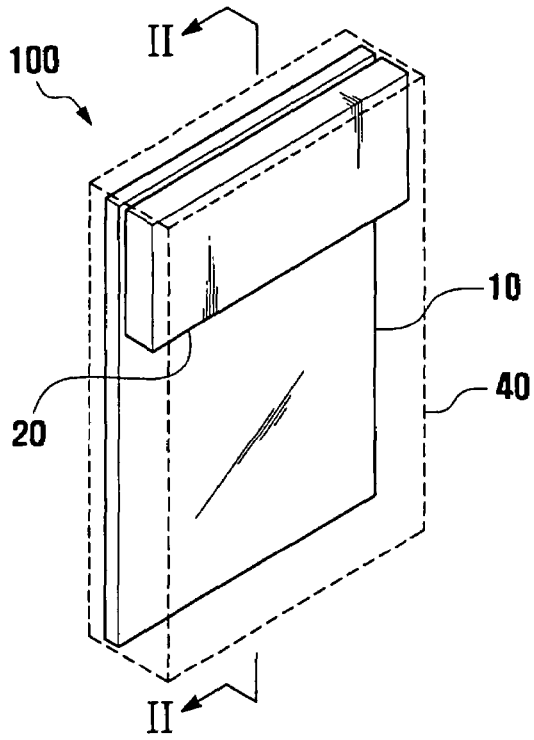
FIG. 1 ( PRIOR ART )
FIG. 1 is a perspective view schematically illustrating a conventional inner antenna for a mobile communication terminal.
Figure 2:
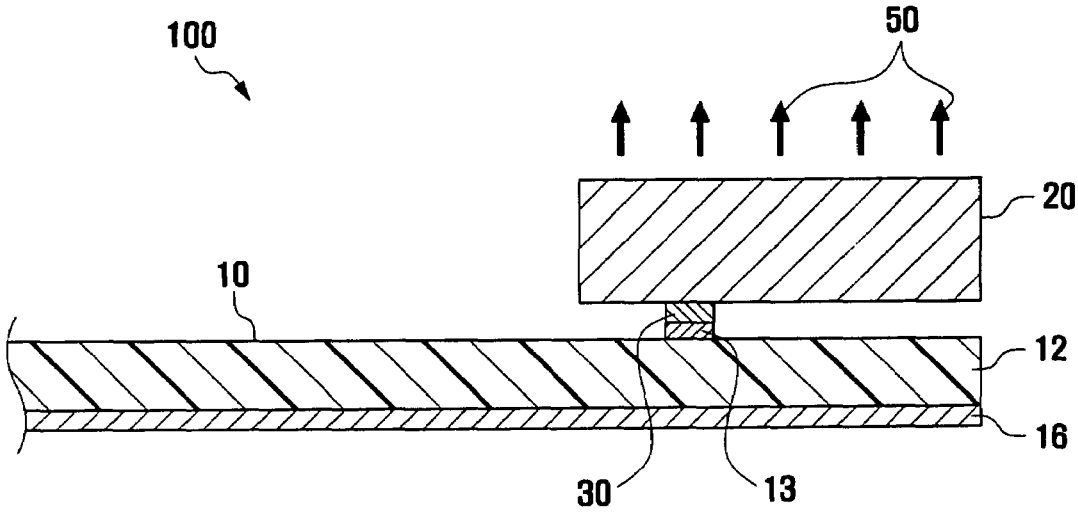
FIG. 2 ( PRIOR ART )
FIG. 2 is a cross-sectional view of the inner antenna taken along line II-II of FIG. 1.

Preferred embodiments of the present invention are described with reference to the accompanying detailed drawings. The same reference numbers are used throughout the drawings to refer to the same or like parts. Detailed descriptions of well-known functions and structures incorporated herein may be omitted to avoid obscuring the subject matter of the present invention.

While the present invention may be embodied in many different forms, specific embodiments of the present invention are shown in the drawings and described herein in detail, with the understanding that the present disclosure is to be considered as an exemplification of the principles of the invention and is not intended to limit the invention to the specific embodiments illustrated.

Figure 3:
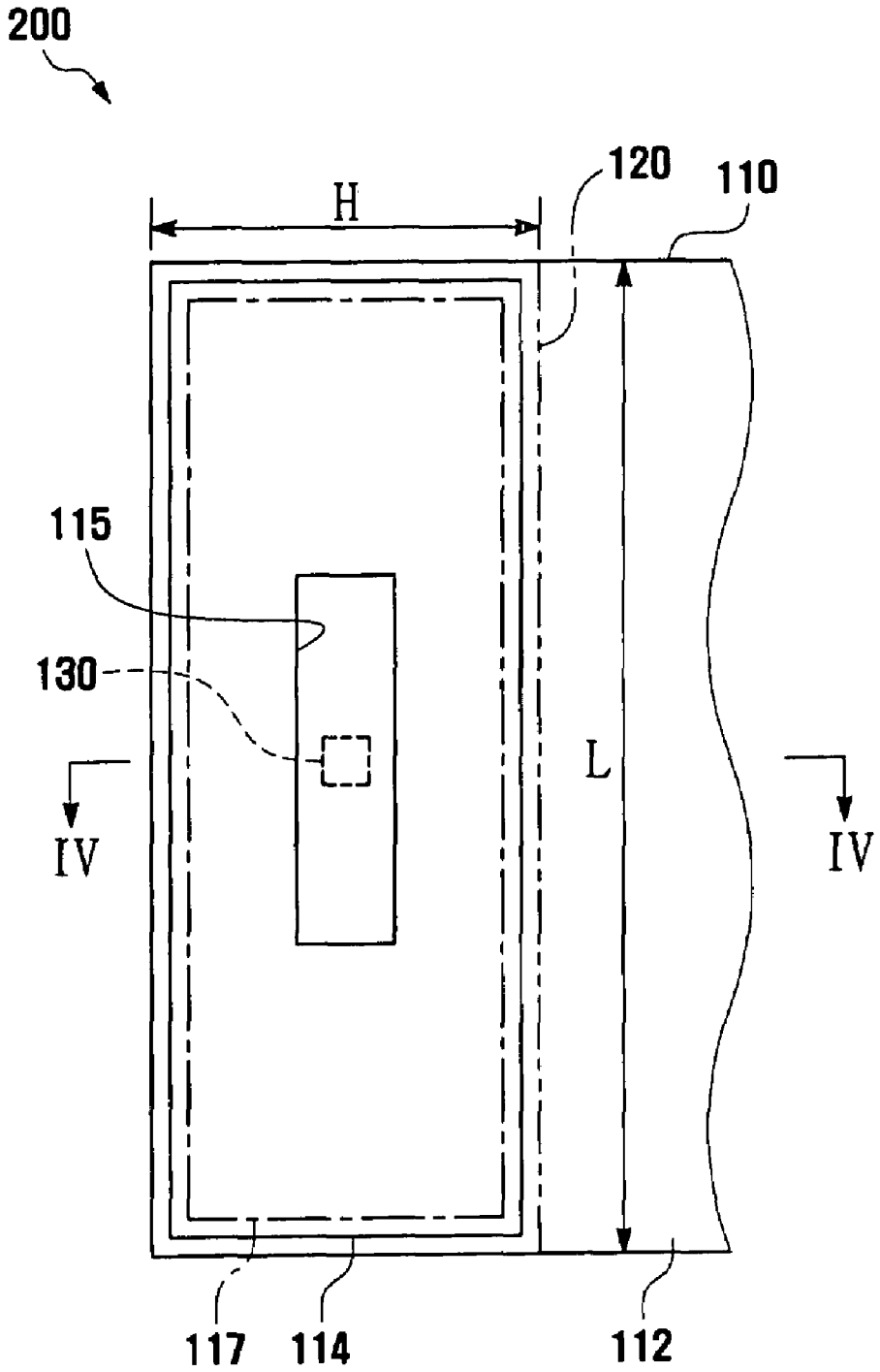
FIG. 3 is a plan view illustrating a dual radiating type inner antenna for a mobile communication terminal according to the present invention.
Figure 4:
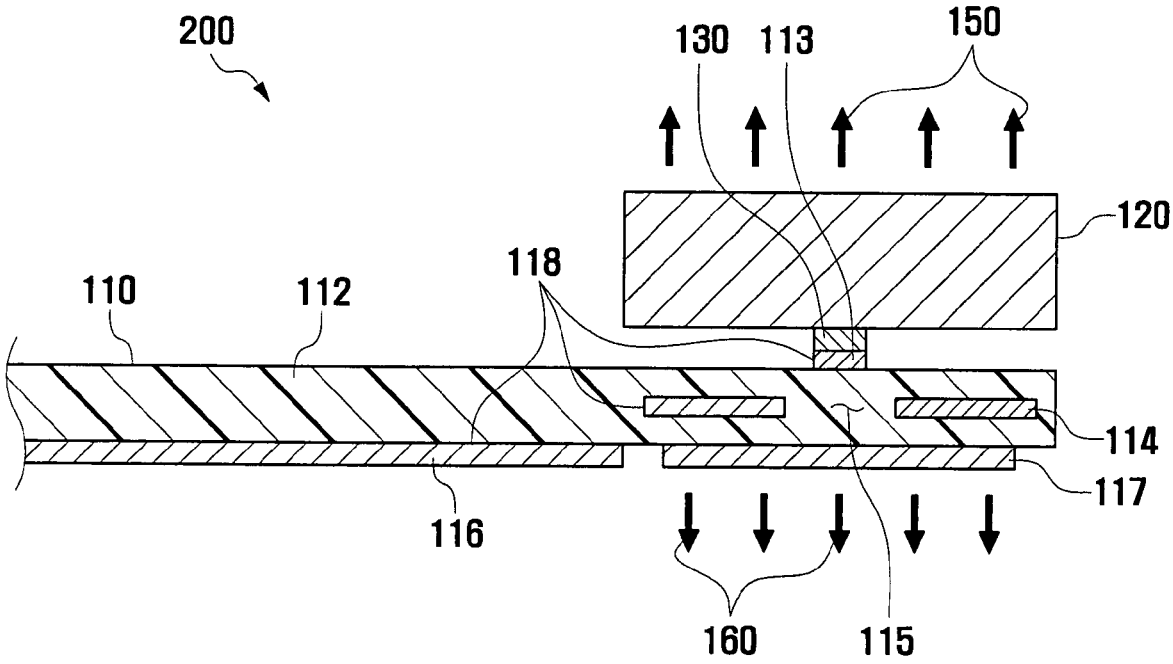
FIG. 4 is a cross-sectional view of the dual radiating type inner antenna taken along line IV-IV of FIG. 3.

FIG. 3 is a plan view illustrating a dual radiating type inner antenna 200 for a mobile communication terminal according to the present invention. FIG. 4 is a cross-sectional view of the dual radiating type inner antenna taken along line IV-IV of FIG. 3.

Referring to FIGS. 3 and 4, the dual radiating type inner antenna 200 according to an exemplary embodiment of the present invention includes a PCB 110, a first radiation plate 120 disposed at an upper part of the PCB 110, and a power supply unit 130 connecting the PCB 110 and the first radiation plate 120 to supply an electrical current to the first radiation plate 120. Particularly, a power supply pad 113 to which the power supply unit 130 is bonded is formed on an upper surface of the PCB 110, and a floating patch 114 having a slot 115 of a size greater than that of the power supply pad 113 is formed within the PCB 110. A ground layer 116 is formed in the lower surface of the PCB 110. A second radiation plate 117 that is separated from the ground layer 116 and that has a size greater than that of the slot 115 is formed on a lower surface of the PCB 110 under the first radiation plate 120.

If electrical current is supplied to the power supply unit 130 through the power supply pad 113 of the PCB 110, a current is radiated as electromagnetic waves 150 of a predetermined frequency band (hereinafter, "first electromagnetic waves") through the first radiation plate 120, and electrical current is also radiated as electromagnetic waves 160 of a predetermined frequency band (hereinafter, "second electromagnetic waves") through the second radiation plate 117 after the current is coupled through the slot 115 of the floating patch 114 from the power supply pad 113. The first electromagnetic waves 150 and the second electromagnetic waves 160 have different frequency bands, with a predetermined overlapping portion of frequency band. The first electromagnetic waves 150 have a relatively higher frequency band than that of the second electromagnetic waves 160.

Therefore, because the inner antenna 200 according to an exemplary embodiment of the present invention simultaneously radiates electromagnetic waves 150 and 160 of different frequency bands, a usable frequency bandwidth can be expanded and the gain of the antenna can be increased. Accordingly, the inner antenna 200 can maintain a stable antenna performance by solving a deterioration problem caused by a frequency shift due to an effect of a human body.

The dual radiating type inner antenna 200 according to an exemplary embodiment of the present invention is described in more detail as follows.

The first radiation plate 120 may be a metal plate having good electrical conductivity, and can be formed in a rectangular shape. For example, the first radiation plate 120 can be formed in a rectangular shape having a rectangular plane in which a vertical height H of the first radiation is longer than a horizontal length L. The horizontal length L of the first radiation plate 120 is substantially the same as that of the PCB 110.

The power supply unit 130 connects a central part of a lower surface of the first radiation plate 120 and an upper surface of the PCB 110 to each other. One surface of the power supply unit 130 is bonded to the power supply pad 113 formed on the upper surface of the PCB 110.

The PCB 110 includes a board body 112 having an upper surface and a lower surface, and a plurality of metal wiring layers 118 formed in both surfaces and in an inner part of the board body 112. The plurality of metal wiring layers 118 can be formed by stacking a plurality of unit PCBs. Many parts are mounted in the PCB 110, but are not necessary for describing the inner antenna 200 according to an exemplary embodiment of the present invention, and therefore are not shown in the drawing.

The board body 112 is an insulation plate of a quadrangular plate shape and the first radiation plate 120 is disposed on an upper surface of the board body 112. The board body 112 is made of prepreg glass-epoxy resin containing glass fiber, BT resin, etc. and is generally made of prepreg. The metal wiring layer 118 is made of copper and formed by patterning a copper foil with a photolithography process after being attached to the board body 112. The metal wiring layer 118 includes power supply pad 113 formed on an upper surface of the board body 112, floating patch 114 formed within the board body 112, and second radiation plate 117 as well as a ground layer 116 formed on the lower surface of the board body 112.

The power supply pad 113 is formed on the upper surface of the board body 112 under the first radiation plate 120 and the power supply unit 130 is connected thereto. Although not shown, a power supply line including the power supply pad 113 is formed in the board body 112.

The slot 115 having a size greater than that of the power supply pad 113 is formed in the central part of the floating patch 114. That is, when the power supply pad 113 is vertically projected towards the floating patch 114, the slot 115 is formed in the floating patch 114 so that the power supply pad 113 may be positioned within the slot 115. Preferably, the slot 115 is formed so that the power supply pad 113 may be positioned in the central part of the slot 115. The slot 115 can be formed in a straight shape, a U shape, and a dumbbell shape and can be also formed in other shapes.

The second radiation plate 117 is formed in the lower surface of the board body 112 under the first radiation plate 120. The second radiation plate 117 is formed in a position that is covered with the first radiation plate 120. The second radiation plate 117 is formed in a position that is covered with the floating patch 114. The second radiation plate 117 is formed in a position that can cover the slot 115 of the floating patch 114. As described above, the position covered refers to covering an object by positioning within a covering object when the covered object is vertically projected on the covering object. For example, when the second radiation plate 117 is vertically projected towards the first radiation plate 120, the second radiation plate 117 is positioned within the first radiation plate 120.

The power supply pad 113, the second radiation plate 117, and the floating patch 114 having the slot 115, are formed in order to smoothly radiate the second electromagnetic waves 160 through the second radiation plate 117 by effectively performing coupling through the slot 115.

The ground layer 116 is disposed apart from the second radiation plate 117 formed on the lower surface of the board body 112. That is, the ground layer 116 is formed to cover the lower surface of the board body 112, other than the second radiation plate 117.

The ground layer 116 and the second radiation plate 117 are integrally formed on the lower surface of the board body 112; and then are separated through a photolithography process.

According to the present invention, the first electromagnetic waves are radiated through the first radiation plate and the second electromagnetic waves are radiated through the second radiation plate after being coupled through the slot of the floating patch from the power supply unit. Therefore, because an inner antenna according to an exemplary embodiment of the present invention simultaneously radiates electromagnetic waves of different frequency bands, a usable frequency bandwidth can be expanded and the gain of the antenna can be increased. Accordingly, the inner antenna can maintain a stable antenna performance by solving a deterioration problem caused by a frequency shift due to an effect of a human body.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. A dual radiating type inner antenna for a mobile communication terminal comprising:

a Printed Circuit Board (PCB);

a first radiation plate provided at an upper part of the PCB; and a power supply unit connecting the PCB and the first radiation plate to supply electric current to the first radiation plate, wherein the PCB comprises:

a board body having an upper surface and a lower surface opposite to the upper surface;

a power supply pad formed in the upper surface of the board body under the first radiation plate, connected to the power supply unit;

a floating patch formed within the board body, wherein the floating patch has a slot larger than the power supply pad formed in a location corresponding to a location of the power supply pad;

a second radiation plate formed on the lower surface of the board body under the first radiation plate; and a ground layer formed on the lower surface of the board body and disposed apart from the second radiation plate, wherein electric current supplied to the power supply unit through the power supply pad is radiated as electromagnetic waves of a first predetermined frequency band through the first radiation plate, and is radiated as electromagnetic waves of a second predetermined frequency band through the second radiation plate after the current is coupled through the slot of the floating patch from the power supply pad wherein the first radiation plate has a size larger than the second radiation plate, the floating patch has a size larger than the second radiation plate, and the second radiation plate has a size larger than the slot of the floating patch.

2. The dual radiating type inner antenna of claim 1, wherein the slot of the floating patch has one of a straight shape, a U shape, and a dumbbell shape.

3. The dual radiating type inner antenna of claim 1, wherein the power supply unit is connected to a central part of the first radiation plate.

4. The dual radiating type inner antenna of claim 3, wherein the power supply pad is positioned in a central part of the slot of the floating patch.

5. A dual radiating type inner antenna for a mobile communication terminal comprising:

a Printed Circuit Board (PCB) having an upper surface and a lower surface opposite to the upper surface;

a first radiation plate provided at the upper surface of the PCB; and a power supply unit connecting the PCB and the first radiation plate to supply a current to the first radiation plate, wherein the PCB comprises:

a power supply pad formed in the upper surface of the PCB and to which the power supply unit is bonded;

a floating patch formed within the PCB and having a slot larger than the power supply pad formed in a location corresponding to a location of the power supply pad;

a second radiation plate formed on the lower surface of the PCB under the floating patch and having a size larger than the slot; and a ground layer covering the lower surface of the PCB, other than the second radiation plate wherein the first radiation plate has a size larger than the second radiation plate, and the floating patch has a size larger than the second radiation plate.

* * * * *